US005553733A

United States Patent [19]

Rosenthal

[11] Patent Number: 5,553,733

[45] Date of Patent: Sep. 10, 1996

[54] ARTICLE COVER

[76] Inventor: Linda M. Rosenthal, 4517 SW. Hemlock Way, Seattle, Wash. 98136

[21] Appl. No.: 296,229

[22] Filed: Aug. 25, 1994

[51] Int. Cl.[6] ..... B65D 90/06

[52] U.S. Cl. ..... 220/400; 220/626; 220/694; 220/908; 150/154; 383/121.1; 206/457

[58] Field of Search ..... 220/400, 403, 220/404, 694, 908, 626; 150/154, 158, 159, 165; 206/389, 409, 457, 494; 383/33, 43, 109, 121.1

[56] References Cited

U.S. PATENT DOCUMENTS

| | | | |
|---|---|---|---|
| 404,785 | 6/1889 | Gibson | 220/400 |
| 1,421,628 | 7/1922 | Watkins . | |
| 2,319,384 | 5/1943 | Callan et al. . | |
| 2,432,662 | 12/1947 | Gardner . | |
| 3,352,449 | 11/1967 | Jackson . | |
| 3,425,472 | 2/1969 | Marino | 383/121.1 X |
| 3,507,312 | 4/1970 | Petersen . | |
| 4,216,620 | 8/1980 | Weder et al. | 150/154 X |
| 4,514,995 | 5/1985 | Curtis et al. . | |
| 4,694,503 | 9/1987 | Haydorn . | |
| 4,822,178 | 4/1989 | Taylor . | |
| 4,844,286 | 7/1989 | Jacobson | 220/401 |
| 4,955,496 | 9/1990 | Nelson . | |
| 5,165,567 | 11/1992 | Richardson et al. . | |

FOREIGN PATENT DOCUMENTS

| | | |
|---|---|---|
| 524616 | 5/1956 | Canada . |

*Primary Examiner*—Stephen K. Cronin
*Attorney, Agent, or Firm*—Joan H. Pauly

[57] ABSTRACT

A cover for articles, such as wastebasket liners and tissue boxes, has a rigid end substantially coextensive with a first end of an article to be covered. A soft tubular pleated sidewall has a first end secured to the rigid end of the cover. The sidewall is sufficiently pliant to permit the cover to be folded into a flattened configuration. A closure extends around the second end of the sidewall to pull it over the periphery of the second end of the article and retain the cover on the article. The opening at the second end of the sidewall is of variable size to permit the cover to be installed on the article. The closure may be a band of elastic. The cover is easily folded for shipment and display and may be made from washable materials to be machine washable. The provision of a rigid end gives the cover the neat appearance of a stiffer type of cover when the cover is in use. The rigid end preferably comprises a pair of members secured together by adhesive with one end of the sidewall extending therebetween to secure the sidewall to the rigid end. The cover may be reversible.

10 Claims, 8 Drawing Sheets

ARTICLE COVER

TECHNICAL FIELD

This invention relates to covers for articles and, more particularly, to a cover having a substantially rigid end dimensioned to be substantially coextensive with a first end of the article, a tubular pleated sidewall secured to the rigid end and being sufficiently pliant to permit the cover to be folded into a flattened configuration, and a closure extending around the sidewall opposite the rigid end to retain the cover on the article.

BACKGROUND INFORMATION

Modern decorating schemes commonly call for the coordination of relatively small accessory items with other decorative elements. For example, a wastebasket for a bedroom may be provided with a cover that matches the drapes and/or comforter in the room. Similarly, a wastebasket and a tissue box for the bathroom may be provided with covers matching a shower curtain. There are presently covers for accessory items of this type available on the market. One type of cover for a wastebasket has a stiff bottom and stiff pleated sidewalls into which a basic wastebasket liner is inserted. This type of cover presents a highly attractive and high quality appearance because the folding or pleating of the cover sidewall is always neatly presented. However, the cover has the disadvantages of being relatively expensive and of having little, if any, flexibility in the choice of the wastebasket liner. It also cannot be machine washed and is not foldable for shipping. Another type of cover that is available on the market has a soft fabric bottom as well as a soft fabric sidewall. This product is foldable, may be machine washable, and is less expensive and more versatile in the type of liner it will accept, but these characteristics are achieved at the expense of the neat appearance of the type of cover with a stiff bottom and a stiff sidewall.

SUMMARY OF THE INVENTION

The present invention relates to a cover for an article having first and second opposite ends and sidewalls extending between the ends. According to an aspect of the invention, the cover comprises a substantially rigid end, a tubular pleated sidewall, and a closure. The rigid end is dimensioned to have a periphery substantially coextensive with the periphery of the first end of the article. The pleated sidewall has a first end secured to the rigid end, and a second end defining a variable size opening for receiving the article therethrough. The sidewall is dimensioned to cover the sidewalls of the article and peripheral portions of the second end of the article when the article has been inserted into the cover through the second end of the sidewall to position the rigid end closely adjacent to the first end of the article. The sidewall is sufficiently pliant to permit the cover to be folded into a flattened configuration. The closure extends around the second end of the sidewall to pull the second end of the sidewall over the periphery of the second end of the article to retain the cover on the article.

As used herein with reference to an article on which the cover of the invention may be installed, the term "sidewalls" refers to a single cylindrical, frustoconical, or other curved sidewall, a plurality of flat sidewalls, or some other configuration. Other aspects of the article sidewalls may also be varied. For example, the sidewalls may be smooth or textured and may have a regular surface or be grooved or ridged. The pleated sidewall of the cover may also be varied. The sidewall may have regular sharply defined pleats or, preferably, soft pleats created by gathering of the sidewall fabric at its connection to the rigid end and at the closure end. The term "pliant" used in reference to the pleated sidewall of the cover refers to a cloth-like quality that enables the sidewall to be folded easily. In the preferred embodiments, the pliant sidewall is of a nature that drapes easily over objects of various sizes and shapes and readily forms soft folds when the sidewall is gathered.

The elements of the cover may be made from various materials. Preferably, the cover is made from washable materials to permit the cover to be machined washed and then reused. The closure may take a variety of forms. In the preferred embodiments, the closure comprises a band of elastic extending around the second end of the pleated sidewall. Another example of a suitable closure is disclosed in U.S. Pat. No. 5,165,567, granted Nov. 24, 1992, to J. A. Richardson et al. The Richardson et al. closure could also be modified by replacing the stiffly flexible element with stitching around the second end of the sidewall.

The currently preferred embodiment of the rigid end comprises a pair of members having confronting surfaces secured together. The first end of the pleated sidewall extends inwardly between and is secured to the confronting surfaces. The details of the configuration of the members may be varied. One possible configuration is members that are substantially flat and have confronting planar surfaces. Other possible configurations include one flat member and another member with a curved or domed outer surface. Whatever the precise shape of the members, one or both of the members may have an outer surface opposite its confronting surface covered by a material matching the pleated sidewall.

An optional feature of the invention is provision of the rigid end in the form of a pair of members having differential peripheral dimensions. The member which is positioned to be adjacent to the first end of the article when the article has been inserted into the cover desirably has peripheral dimensions slightly larger than the corresponding peripheral dimensions of the other member. This feature is particularly advantageous in connection with a cover for a wastebasket in which the rigid end is the bottom. In such a cover, the slightly larger dimensions of the inner member contribute to and enhance the neat appearance of the pleated sidewall. The smaller outer disk is generally not visible when the wastebasket is in use so that attention is focused solely on the neatly pleated sidewall.

Another optional feature of the invention is a cover that is reversible. The reversibility can be accomplished by providing a pleated sidewall that has opposite faces with different patterns thereon. The two faces may simply be different colors or one or both of the faces may have a design thereon, such as a floral design. The cover may be reversed to enable either of the faces to be directed away from the sidewalls of the article when the article is inserted into the cover so that the outwardly directed face is visible to an observer. A desirable form of the reversible pleated sidewall is a pleated sidewall that comprises two layers of fabric. Such an arrangement may be provided in combination with washability of both the layers of fabric and the other elements of the cover. When the cover includes the combination of a reversible sidewall and a rigid end comprising two confronting members, each of the members may have an outer surface opposite its confronting surface and covered by a material matching an adjacent face of the pleated sidewall.

The cover of the invention achieves the advantages of each of the two types of known covers discussed above without sacrificing the advantages of the other known type. The cover of the invention may easily be folded into a small neat package for shipment and display for sale. It is also relatively inexpensive to manufacture, flexible in the choice of liner or other article with which it is used, and readily made in a washable form. In addition to these advantages, the cover of the invention, in use, has essentially the same highly attractive and high quality appearance of the known stiff type of cover.

These and other advantages and features will become apparent from the detailed description of the best modes for carrying out the invention that follows.

BRIEF DESCRIPTION OF THE DRAWINGS

In the drawings, like element designations refer to like parts throughout, and.

BEST MODES FOR CARRYING OUT THE INVENTION

Figure 1:
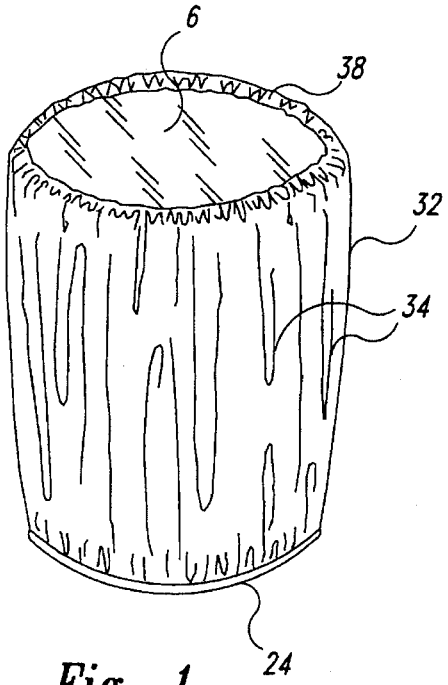
FIG. 1 is a pictorial view of a first preferred embodiment of the invention in use to cover a wastebasket liner.

The drawings show two types of covers and two modifications of one of the types that are constructed according to the invention and that also constitute the best modes for carrying out the invention currently known to the applicant. In the drawings, the covers are shown in use for covering two types of articles, a wastebasket liner 2 and a square tissue box. These articles are shown for the purposes of illustration. It is intended to be understood that the cover of the invention may also be used in connection with other types of wastebasket liners and tissue boxes and other kinds of articles. It should also be understood that the dimensions of various elements are exaggerated in the drawings for purposes of illustration.

In FIGS. 1, 3, 4, 5, and 6, a first embodiment of the cover 12 is shown in use installed on a wastebasket liner 2 of a known type. The liner 2 has a first bottom end 4 and a frustoconical sidewall 6 extending upwardly from the bottom 4. A flange 8 extends radially outwardly from the upper end of the sidewall 6. The liner 2 is shown as being made from a transparent material, such as transparent plastic. The liner could also be made from opaque plastic or some other material, such as metal, cardboard, or wicker. In addition, the configuration of the liner can be varied, such as by omitting the top flange 8 and/or providing a cylindrical sidewall.

Figure 2:
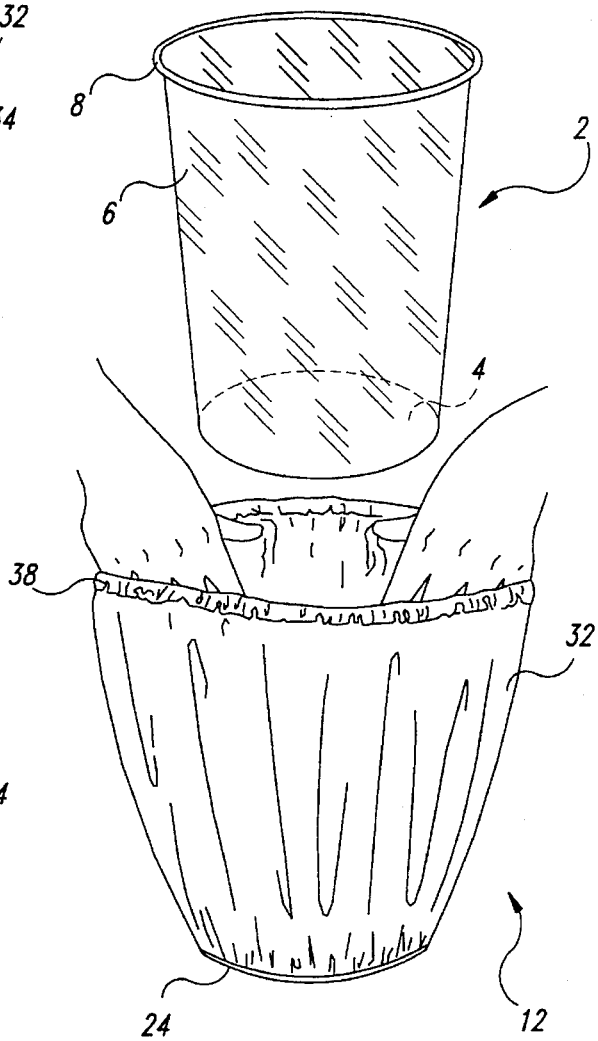
FIG. 2 is a pictorial view illustrating the positioning of the cover shown in FIG. 1 preparatory to placing it over the liner.
Figure 3:
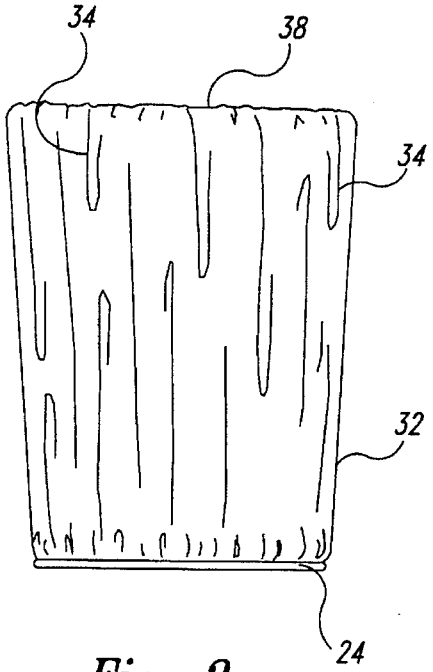
FIG. 3 is an elevational view of the cover and liner shown in FIG. 1.
Figure 4:
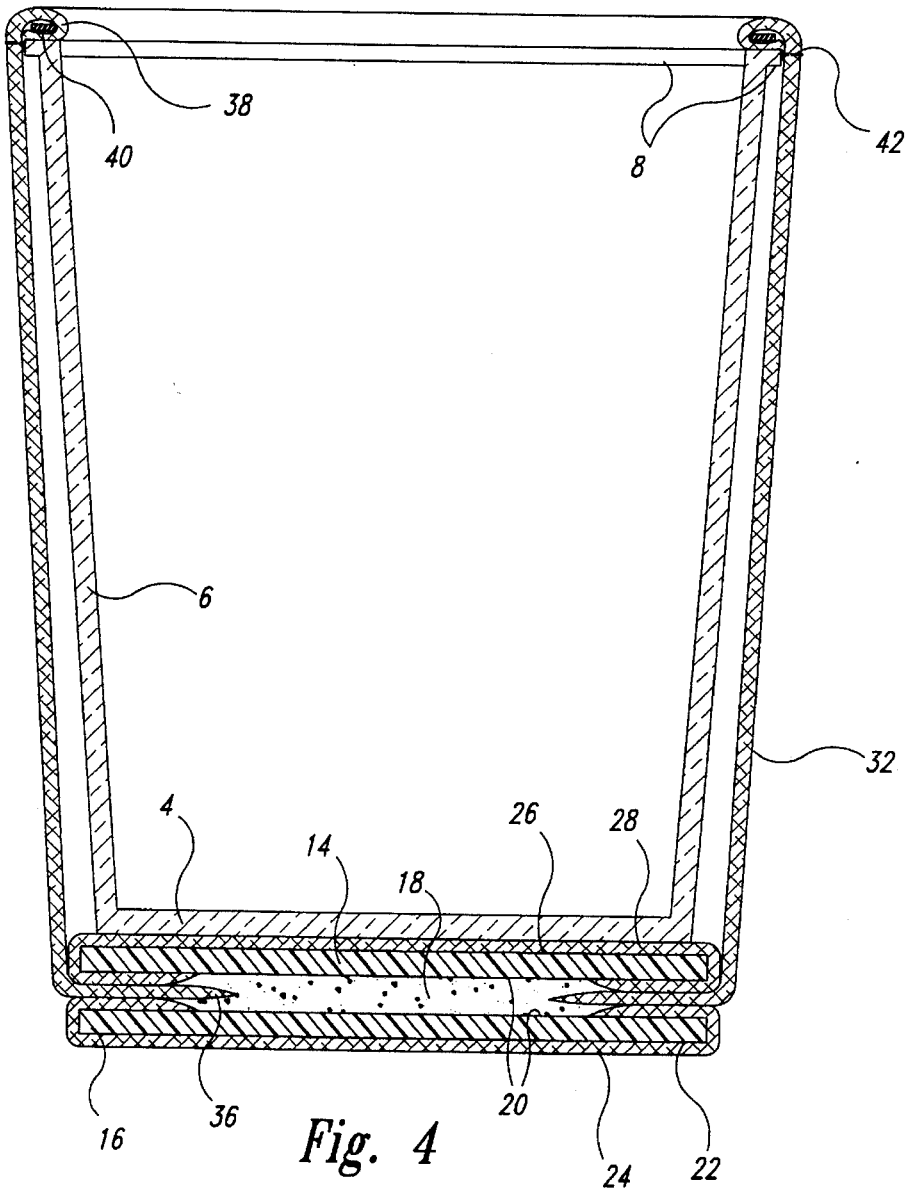
FIG. 4 is a vertical sectional view of the cover and liner shown in FIGS. 1 and 3.
Figure 6:
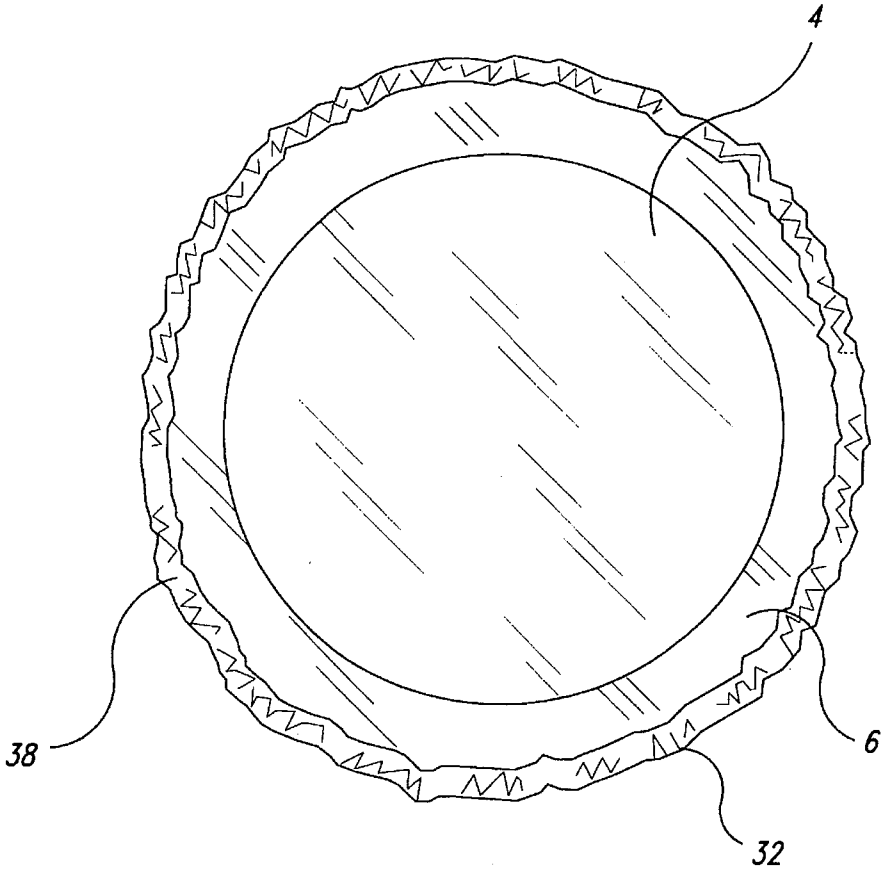
FIG. 6 is a top plan view of the cover and liner shown in FIG. 1.
Figure 5:
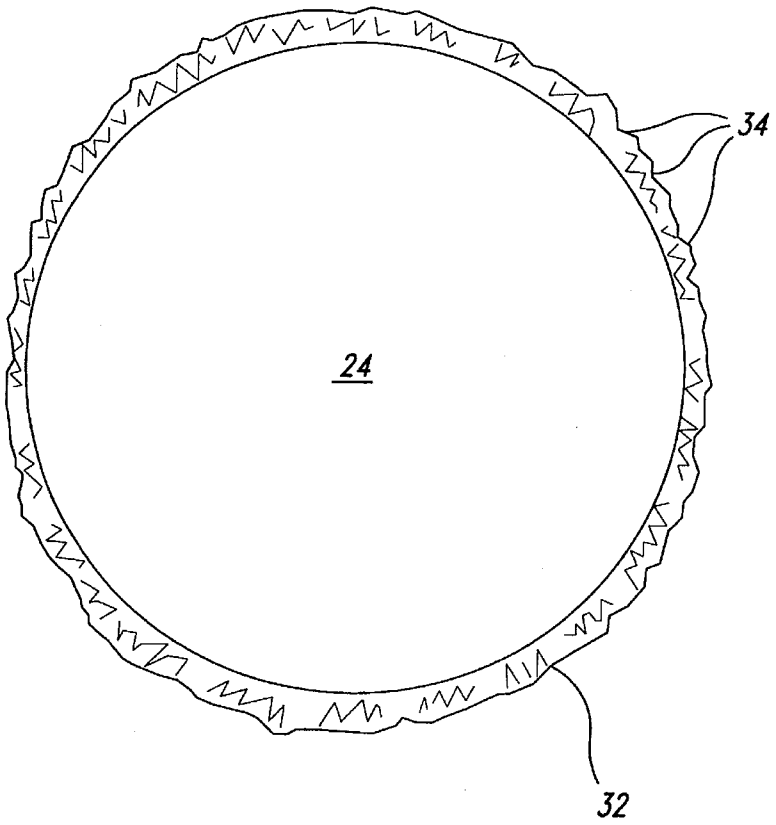
FIG. 5 is a bottom plan view of the cover shown in FIGS. 1 and 3.
Figure 8:
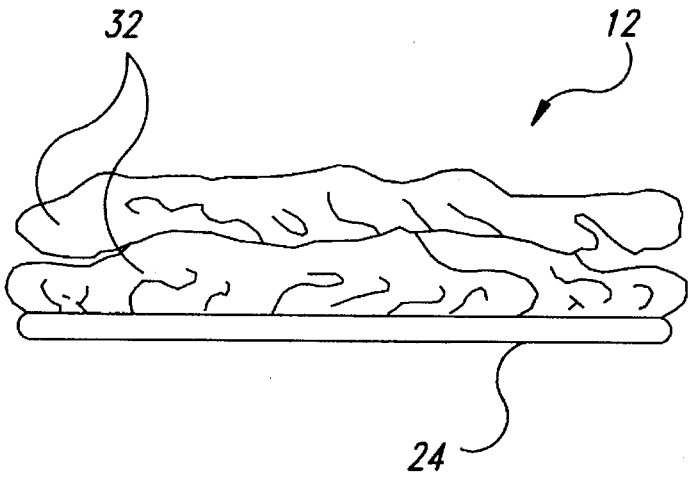
FIG. 8 is an elevational view of the cover shown in FIGS. 1–7 and illustrates the flattened folded configuration.

The cover 12 shown in FIGS. 1–4 and 5–8 comprises a first rigid end 14, 16, a soft pleated sidewall 32, and a second end 38 that is drawn radially inwardly around the top flange 8 of the liner 2 to securely retain the cover 12 on the liner 2, as shown in FIGS. 1, 4, and 6. Referring to FIG. 4, the rigid end comprises an inner member 14 and an outer member 16. As shown, each of these members 14, 16 is a flat circular plastic disk. Both the material and the configuration of the members could be varied. For example, rather than being circular, one or both of the disks could be annular to conserve material and reduce the weight of the cover. In addition, the outer edges of the disks could be square, hexagonal, or some other shape to match or enhance the shape of the article being covered. The members 14, 16 are preferably made from a rigid, durable, waterproof (washable) plastic so that the entire cover 12 is machine washable. Examples of suitable plastics include Phillips K-resin (trademark), crystal styrene, and polycarbonate. However, the members may also be made from other types of plastic, cardboard, or some other material.

Still referring to FIG. 4, the members 14, 16 preferably have planar confronting surfaces 20 that are secured together by an adhesive 18. The members could also be secured together in other ways, such as by providing them with snap-together elements. As shown, each of the members 14, 16 has an outer surface 26, 22 that is provided with a fabric covering 28, 24. These covers 28, 24 are preferably of a material that matches the material of the sidewall 32 or is complementary thereto. One or both of the covers 28, 24 may be omitted.

Figure 7:
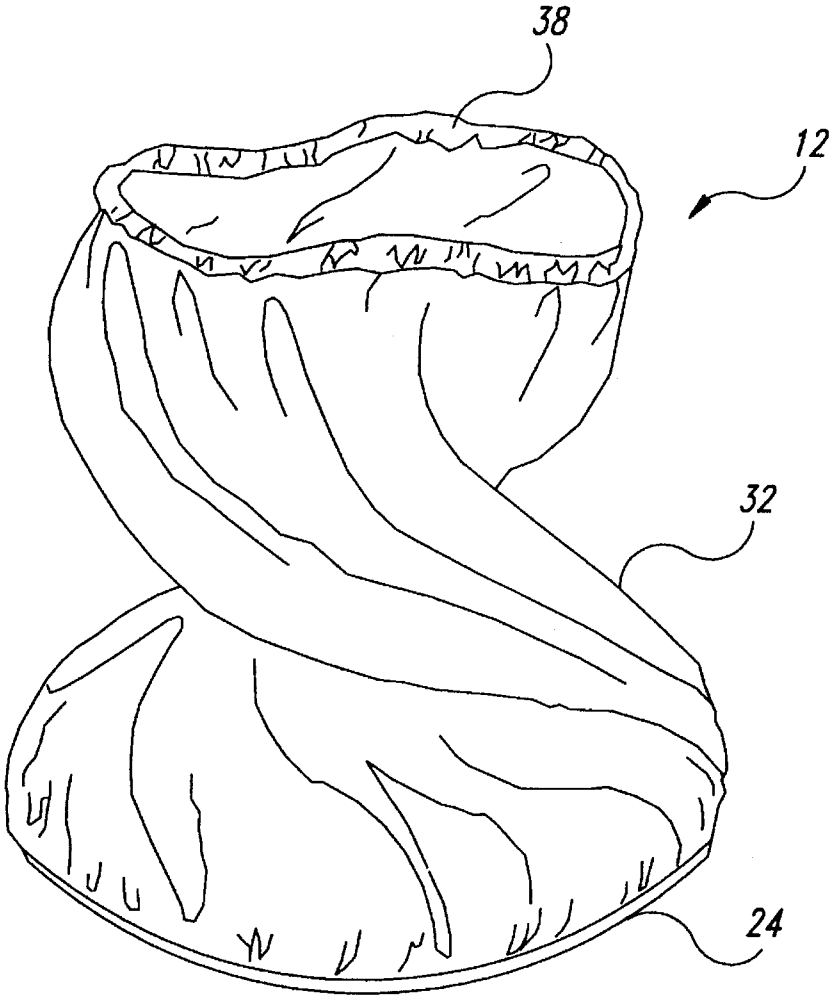
FIG. 7 is a pictorial view of the cover shown in FIGS. 1–6 illustrating an intermediate stage of the folding of the cover into a flattened configuration.

The sidewall 32 of the cover 12 has a tubular pleated configuration when the cover 12 is in use, as shown in FIGS. 1, 3, and 4. The pleating of the sidewall is preferably in the form of soft irregular folds 34, shown in FIGS. 1 and 3. These folds 34 are created by gathering of the opposite ends 36, 38 of the sidewall 32. The sidewall 32 is sufficiently pliant to permit the cover 12 to be folded into a flat configuration, such as the configuration shown in FIG. 8. As illustrated in FIG. 4, the sidewall 32 is made from a single layer of fabric. This fabric is preferably washable to enable the entire cover 12 to be washed and reused. FIG. 7 illustrates the folding of the cover 12 into the flattened configuration of FIG. 8. During the folding procedure, the sidewall 32 is twisted slightly and the upper end 38 of the sidewall 32 is pushed downwardly to be adjacent to the rigid end of the cover 12.

The first end 36 of the sidewall 32 is secured to the rigid end 14, 16. As shown in FIG. 4, the end 36 extends radially inwardly between the two end members 14, 16 to be secured by the adhesive 18 that secures together the confronting surfaces 20 of the end members 14, 16. The opposite second end 38 of the sidewall 32 defines a variable size opening for receiving the liner 2 therethrough. As can be seen in FIG. 4, the sidewall 32 is dimensioned to cover the frustoconical sidewall 6 and the upper peripheral portion provided by the top flange 8 of the liner 2. When the cover 12 is so installed on the liner 2, the rigid end 14, 16 of the cover 12 is closely adjacent to and abuts the bottom surface of the bottom 4 of the liner 2.

The upper end 38 of the sidewall 32 is provided with a closure extending around the upper end 38 to pull the upper end 38 over the upper periphery of the liner 2 to retain the cover 12 on the liner 2. As shown, the closure may take the form of a simple band of elastic 40. The upper end 38 of the sidewall fabric is folded around the band 40 and stitched at 42 to attach the band 40 to the upper end 38 but allow the upper end 38 to retain a soft gathered appearance. The elastic could also be attached in other ways, such as by stitching it directly to the folded edge of the fabric. FIG. 2 illustrates the installation of the cover 12 onto the liner 2. The elastic 40 is manually stretched to increase the size of the top opening, and the cover 12 is simply pulled onto the liner 2.

Figure 11:
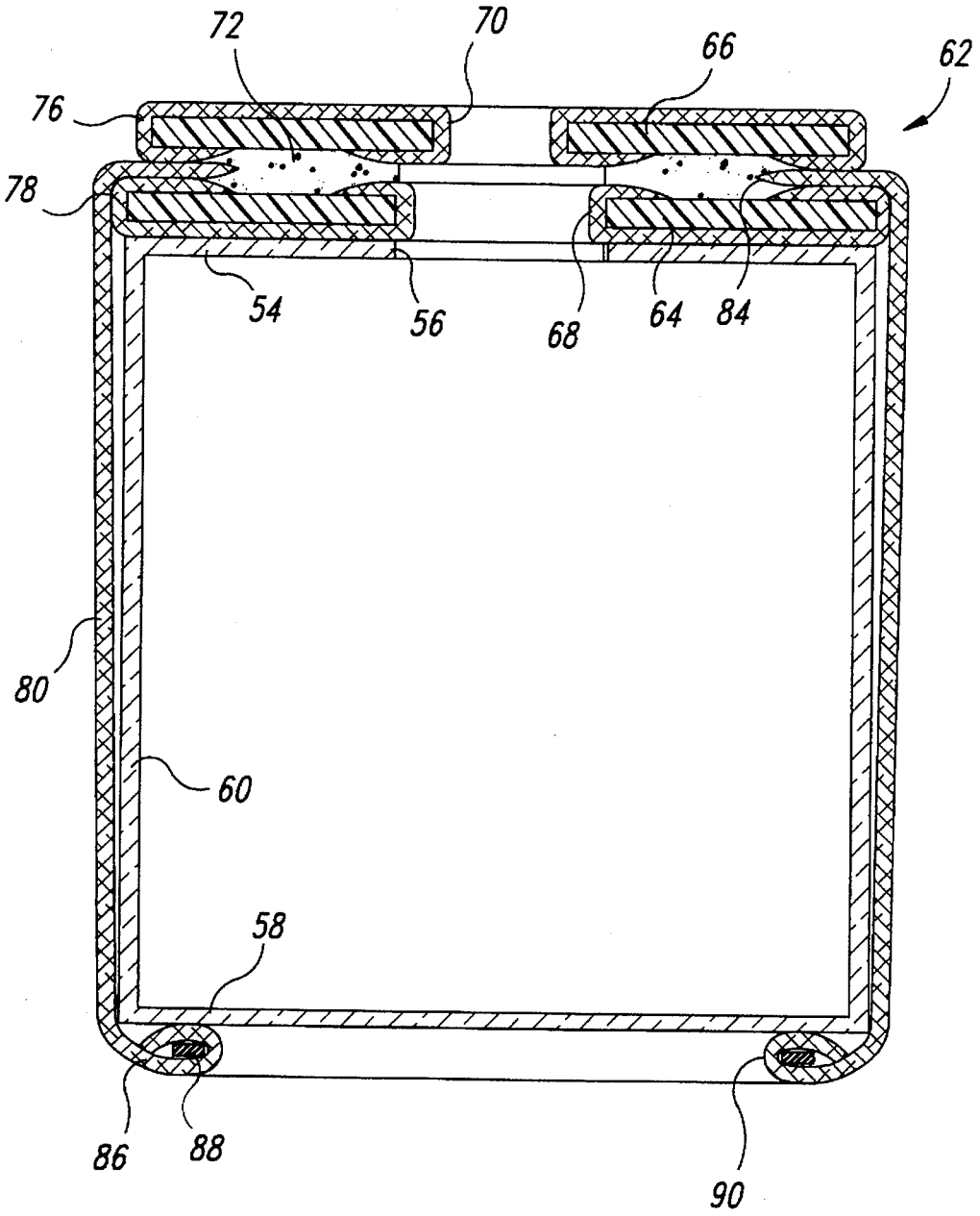
FIG. 11 is a sectional view of the cover shown in FIG. 9.
Figure 13:
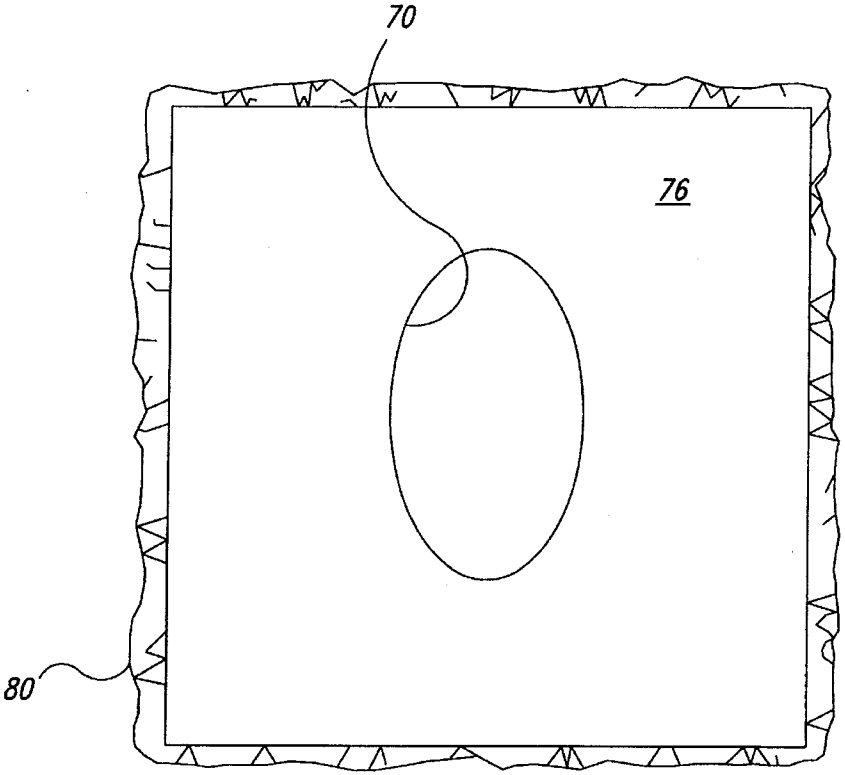
FIGS. 12 and 13 are bottom and top plan views, respectively, of the cover and tissue box shown in FIGS. 9–11.
Figure 12:
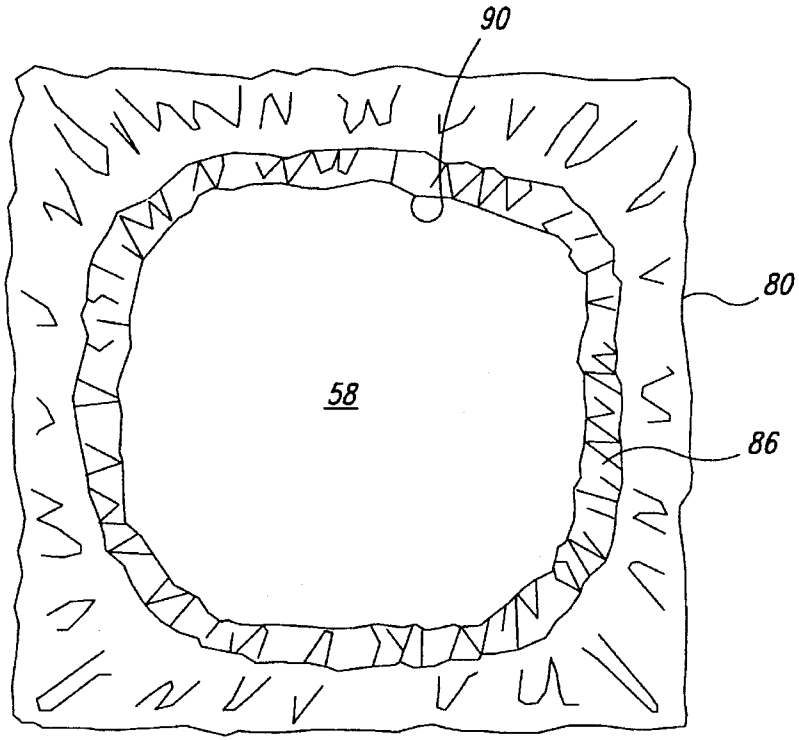

The rigid end of the cover has peripheral dimensions substantially coextensive with the periphery of the corresponding end of the article to be covered so that the cover will have a good fit on the article. As shown in FIGS. 4 and 11, the inner member 14, 64 of a two-member rigid end is preferably at least as large as the corresponding end of the article. In the wastebasket cover 12 shown in FIG. 4, the inner member 14 is somewhat larger than the bottom 4 of the liner 2. This relatively minor difference in dimensioning results in a more cylindrical appearance of the covered liner 2 to compensate for the presence of the top flange 8. It also allows the illustrated cover 12 to be used with a liner having a wider bottom than the illustrated liner 2.

Figure 4A:
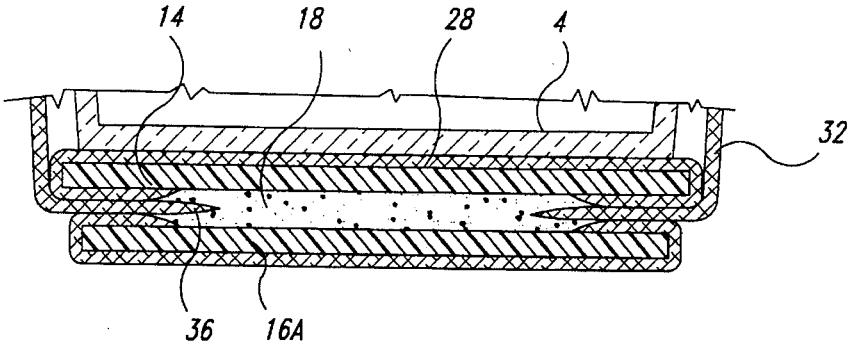
FIG. 4A is a fragmentary sectional view similar to the bottom portion of FIG. 4 except that it illustrates a modified form of the bottom of the cover.

FIG. 4A shows a modification of the rigid end of the cover 12 shown in FIGS. 1–4 and 5–8. In this modification, the diameter of the outer bottom disk 16A is slightly smaller than the diameter of the inner disk 14. The difference is exaggerated in FIG. 4A for purposes of illustration. A desirable difference is, for example, an outer disk with a diameter two and a half to three percent smaller than the diameter of the inner disk. In prototypes of the invention made for wastebasket liners, it has been found that the feature of a smaller outer end member 16A enhances the appearance of the cover when it is installed on a liner. The feature would not generally be desirable for use on a cover in which the rigid end is an upper end, such as in the tissue box cover 62 shown in FIGS. 9–13.

FIG. 45 shows another modification of the cover 12 shown in FIGS. 1–4 and 5–8. This modified form of the cover is reversible so that either one of the opposite faces of the sidewall 32B, 33B may be positioned to face outwardly when the liner 2 is inserted into the cover. The opposite faces of the sidewall may have different patterns thereon to enable the use of a single cover to achieve two different decorative effects. As noted above, the difference in the patterns may be simply a difference in solid colors or may be a more complicated difference, such as the use of a floral, striped, etc. design on one or both of the surfaces.

FIG. 45 illustrates the preferred manner in which the reversibility of the cover is attained. As shown in FIG. 45B, the sidewall comprises two layers of fabric 32B, 33B. The inner layer 33B faces toward the liner sidewall 6 and is not visible from the outside of the liner 2. The outer layer 32B is directed away from the liner sidewall 6 and is visible from the outside so that it controls the decorative effect of the cover. The cover may be removed and reversed to make the other layer of fabric 33B face outwardly to change the decorative effect.

As in the embodiment shown in FIG. 4, the first end 36B of the sidewall 32B, 33B is secured to the rigid end of the cover by extending it between the two end disks 14, 16. The opposite upper end 38B of the sidewall is provided with a band of elastic 40 to retain the modified cover on the liner 2 in the same way that the cover 12 shown in FIG. 4 is retained. The only difference is the manner in which the upper end 38B of the sidewall is stitched to retain the band of elastic 40. The two layers of fabric 32B, 33B are stitched together at 43B and then their very ends are folded inwardly and stitched together at 44B to form an annular space in which the elastic 40 is positioned. Alternatively, the elastic could be sandwiched between the folded edges of the fabric and stitched directly thereto. The bottom disks 14, 16 may be provided with coverings 28, 24 like the coverings shown in FIG. 4. Preferably, the covering 28 on the disk 14 matches or complements the sidewall layer 33B, and the covering 24 on the disk 16 matches or complements the sidewall layer 32B so that each covering 28, 24 matches an adjacent face of the sidewall. Piping (not shown) may be provided around sidewall 32B, 33B at its interface with the end members 14, 16 to hide the interface.

FIGS. 9–13 illustrate a cover 62 designed for use on a square tissue box of a commercially available type. The cover 62 could also be modified to cover a tissue box with a rectangular or some other configuration. Referring to FIG. 11, the tissue box is made from cardboard and has a top 54 with an oval opening 56 for dispensing tissues from the box. The box has four sidewalls 60 at right angles to each other and extending downwardly from the top 54 to a closed bottom 58.

The cover 62 has a rigid top end comprising an inner member 64 and an outer member 66. These members have openings 68, 70, respectively, that overlay the opening 56 in the top of the tissue box to permit tissues to be dispensed from the covered box. As shown, the outer opening 70 may be smaller than the inner opening 68 to enhance the appearance of the cover 62. The two members of the rigid top end are secured together by adhesive 72. Each of the members 64, 66 may be provided with a covering 78, 76 to match the sidewall 80 of the cover 62. Either of these coverings 76, 78 may be omitted. In particular, the inner covering 78 may be omitted, especially when the inner member 64 is a plastic material of a coordinated color, without detracting from the quality of the cover 62.

Figure 10:
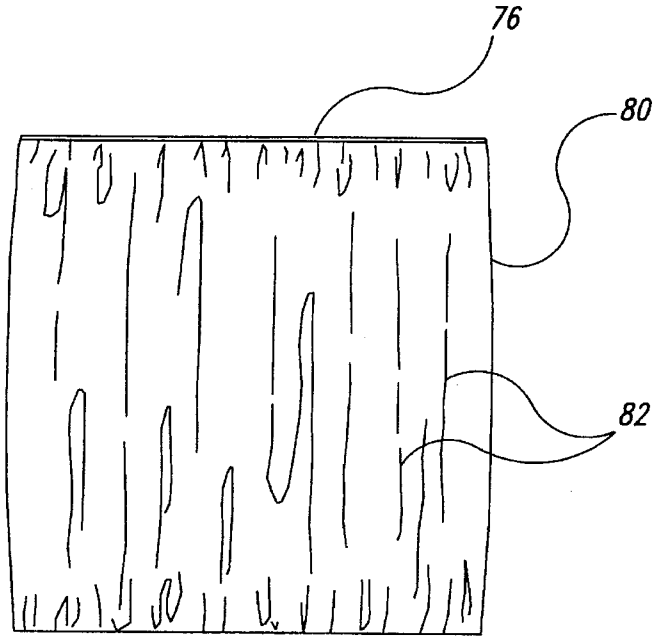
FIG. 10 is an elevational view of the cover shown in FIG. 9.
Figure 9:
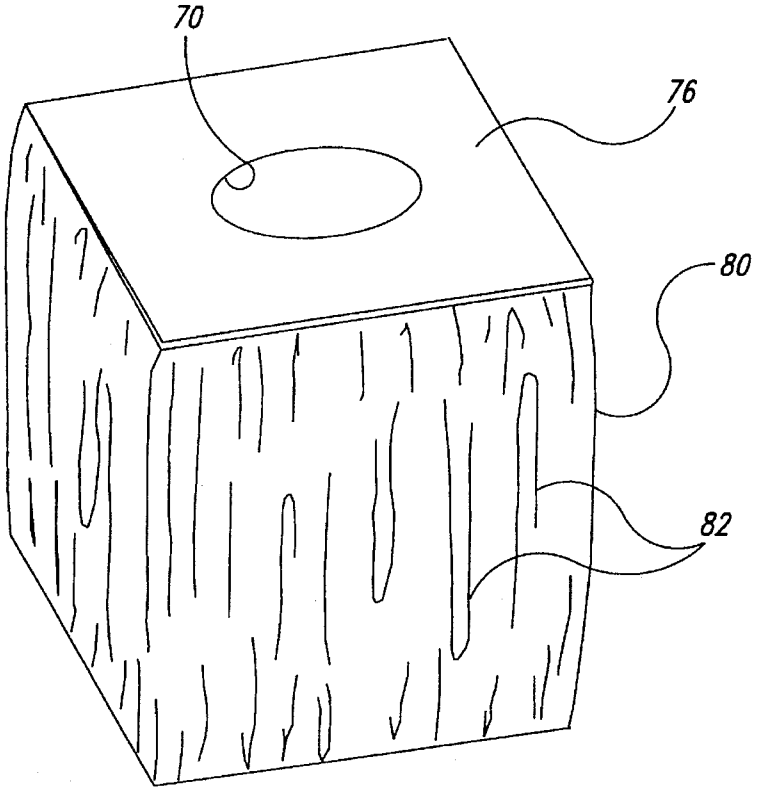
FIG. 9 is a pictorial view of another preferred embodiment of the invention in use to cover a tissue box.

As in the other embodiment 12 of the cover described above, the tissue box cover 62 has a soft fabric sidewall 80 that forms soft folds 82, illustrated in FIGS. 9 and 10. The first or top end 84 of the sidewall 80 is attached to the end members 64, 66 in the same way that the first end 36 of the cover 12 is attached to the bottom disks 14, 16. The second end 86 has an elastic band 88 held in place by stitching in the manner illustrated in FIG. 4. The elasticized end 86 defines a variable size opening 90 to retain the cover 62 on the tissue box and permit the cover 62 to be installed on and removed from the box.

In each of the illustrated embodiments, the two members of the rigid end each have a flat configuration. This configuration may be varied. For example, in a cover for a tissue box, a domed upper surface of the top or outer end member can be used to give the covered box a padded appearance. In addition or alternatively, actual padding may be provided. Other variations may also be used to create different effects and/or to accommodate different configurations of the article being covered.

Although the preferred embodiments of the invention have been illustrated and described herein, it is intended to be understood by those skilled in the art that various modifications and omissions in form and detail may be made without departing from the spirit and scope of the invention as defined by the following claims.

What is claimed:

1. A cover for an article having first and second opposite ends and at least one sidewall extending between said ends, comprising:

a substantially rigid end dimensioned to have a periphery substantially coextensive with the periphery of said first end of the article;

a tubular pleated sidewall having a first end secured to said rigid end, and a second end defining a variable size opening for receiving the article therethrough; said pleated sidewall being dimensioned to cover said sidewall of the article and peripheral portions of said second end of the article when the article has been inserted into the cover through said second end of said pleated sidewall to position said rigid end closely adjacent to said first end of the article, and said pleated sidewall being sufficiently pliant to permit the cover to be folded into a flattened configuration; and a closure extending around said second end of said pleated sidewall to pull said second end of said pleated sidewall over the periphery of said second end of the article to retain the cover on the article;

in which said rigid end comprises a pair of members having confronting surfaces secured together, and said first end of said pleated sidewall extends inwardly between and is secured to said confronting surfaces; and in which one of said members has an outer surface opposite said confronting surface and covered by a material matching said pleated sidewall.

2. A cover for an article having first and second opposite ends and at least one sidewall extending between said ends, comprising:

a substantially rigid end dimensioned to have a periphery substantially coextensive with the periphery of said first end of the article;

a tubular pleated sidewall having a first end secured to said rigid end, and a second end defining a variable size opening for receiving the article therethrough; said pleated sidewall being dimensioned to cover said sidewall of the article and peripheral portions of said second end of the article when the article has been inserted into the cover through said second end of said pleated sidewall to position said rigid end closely adjacent to said first end of the article, and said pleated sidewall being sufficiently pliant to permit the cover to be folded into a flattened configuration; and a closure extending around said second end of said pleated sidewall to pull said second end of said pleated sidewall over the periphery of said second end of the article to retain the cover on the article;

in which said rigid end comprises a pair of substantially flat members having confronting planar surfaces secured together, and said first end of said pleated sidewall extends inwardly between and is secured to said confronting planar surfaces; and in which one of said members has an outer surface opposite said confronting surface and covered by a material matching said pleated sidewall.

3. The cover of claim 2, in which each of said members has an outer surface opposite said confronting surface and covered by a material matching said pleated sidewall.

4. The cover of claim 2, in which the cover is made from washable materials to permit the cover to be machine washed and then reused.

5. The cover of claim 3, in which the cover is made from washable materials to permit the cover to be machine washed and then reused.

6. A cover for an article having first and second opposite ends and at least one sidewall extending between said ends, comprising:

a substantially rigid end dimensioned to have a periphery substantially coextensive with the periphery of said first end of the article;

a tubular pleated sidewall having a first end secured to said rigid end, and a second end defining a variable size opening for receiving the article therethrough; said pleated sidewall being dimensioned to cover said sidewall of the article and peripheral portions of said second end of the article when the article has been inserted into the cover through said second end of said pleated sidewall to position said rigid end closely adjacent to said first end of the article, and said pleated sidewall being sufficiently pliant to permit the cover to be folded into a flattened configuration; and a closure extending around said second end of said pleated sidewall to pull said second end of said pleated sidewall over the periphery of said second end of the article to retain the cover on the article;

in which said pleated sidewall has opposite faces with different patterns thereon, and the cover is reversible to enable either of said faces to be directed away from said sidewall of the article when the article is inserted into the cover.

7. The cover of claim 6, in which said pleated sidewall comprises two layers of fabric.

8. The cover of claim 7, in which the cover is made from washable materials to permit the cover to be machine washed and then reused.

9. The cover of claim 6, in which said rigid end comprises a pair of substantially flat members having confronting planar surfaces secured together, and said first end of said pleated sidewall extends inwardly between and is secured to said confronting planar surfaces.

10. The cover of claim 9, in which each of said members has an outer surface opposite said confronting surface and covered by a material matching an adjacent face of said pleated sidewall.

* * * * *

UNITED STATES PATENT AND TRADEMARK OFFICE

CERTIFICATE OF CORRECTION

PATENT NO. : 5,553,733

DATED : September 10, 1996

INVENTOR(S) : Linda M. Rosenthal

It is certified that error appears in the above-indentified patent and that said Letters Patent is hereby corrected as shown below:

Title page, item
Cover [56], under "References Cited", "Haydorn" should be -- Hydorn --.

Title page, item
[56], under "FOREIGN PATENT DOCUMENTS", insert -- 2,644,331 9/1990 France --.

Figure 4B:
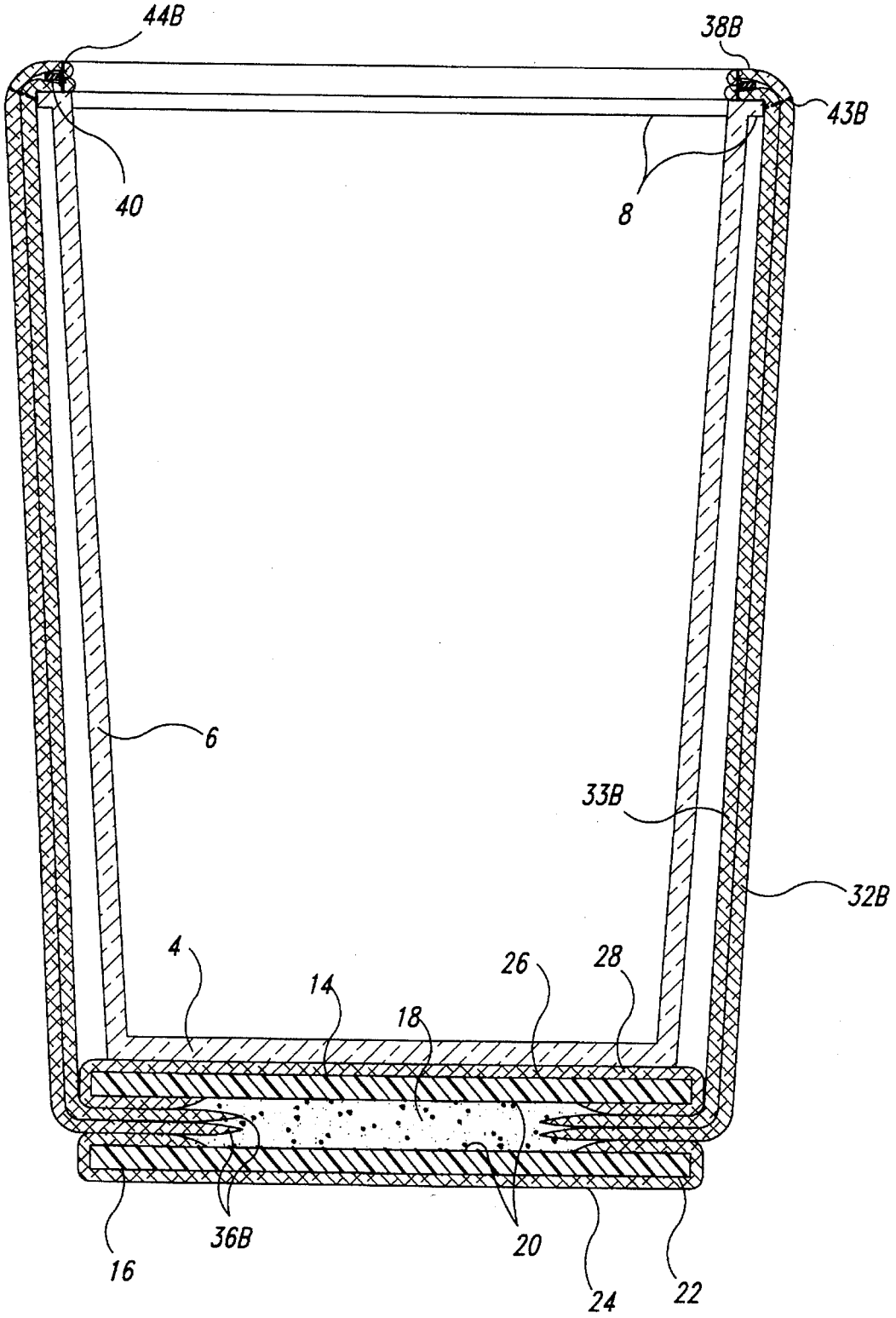
FIG. 4B is like FIG. 4 except that it shows a modification of the cover of FIG. 4 to make the cover reversible.

Column 5, lines 49 and 60, "Fig. 45" should be -- Fig. 4B --.

Column 5, line 61, "Fig. 45B" should be -- Fig. 4B --.

Signed and Sealed this

Twenty-fourth Day of December, 1996

*Attest:*

Bruce Lehman

BRUCE LEHMAN

*Attesting Officer*

*Commissioner of Patents and Trademarks*